US012559147B2

(12) United States Patent
Wakimoto et al.

(10) Patent No.: US 12,559,147 B2
(45) Date of Patent: Feb. 24, 2026

(54) STATE-MONITORING DEVICE AND MAINTENANCE WORK ASSISTANCE METHOD

(71) Applicant: Mitsubishi Electric Corporation, Tokyo (JP)

(72) Inventors: Koji Wakimoto, Tokyo (JP); Takafumi Ueda, Tokyo (JP); Osamu Arai, Tokyo (JP); Kentaro Funato, Tokyo (JP); Tatsuya Shiraishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 555 days.

(21) Appl. No.: 17/798,214

(22) PCT Filed: Feb. 25, 2020

(86) PCT No.: PCT/JP2020/007402
§ 371 (c)(1),
(2) Date: Aug. 8, 2022

(87) PCT Pub. No.: WO2021/171345
PCT Pub. Date: Sep. 2, 2021

(65) Prior Publication Data

US 2023/0117073 A1 Apr. 20, 2023

(51) Int. Cl.
*B61L 15/00* (2006.01)
*B61L 27/70* (2022.01)

(52) U.S. Cl.
CPC ..... *B61L 15/0081* (2013.01); *B61L 27/70* (2022.01)

(58) Field of Classification Search
CPC ..... B61L 15/0081; B61L 27/70; B61L 27/57
(Continued)

(56) References Cited

U.S. PATENT DOCUMENTS

2009/0300430 A1* 12/2009 Nissan-Messing ..... G06F 11/0793 714/48
2017/0090466 A1* 3/2017 Uomori ..... G05B 19/41875
(Continued)

FOREIGN PATENT DOCUMENTS

CN 109131442 A 1/2019
EP 2657102 A2 * 10/2013 ..... B61L 15/0018
(Continued)

OTHER PUBLICATIONS

International Search Report (PCT/ISA/210) with translation and Written Opinion (PCT/ISA/237) mailed on May 26, 2020, by the Japan Patent Office as the International Searching Authority for International Application No. PCT/JP2020/007402. (10 pages).
(Continued)

*Primary Examiner* — Hunter B Lonsberry
(74) *Attorney, Agent, or Firm* — Buchanan Ingersoll & Rooney PC

(57) ABSTRACT

A state-monitoring device includes: a state estimating unit to estimate a state of an instrument using operation information of a train on which the instrument is mounted; an instrument arrangement storing unit to store instrument arrangement information indicating arrangement of the instrument in the train; and a work plan output unit to extract the instrument to be maintained that requires inspection or component replacement on the basis of a state estimation value of the instrument, and output information regarding maintenance work in which the instrument to be maintained and the instrument arrangement information are associated with each other.

8 Claims, 12 Drawing Sheets

(58) Field of Classification Search
USPC ..... 701/29
See application file for complete search history.

(56) References Cited

U.S. PATENT DOCUMENTS

| | | | | |
|---|---|---|---|---|
| 2017/0369084 | A1* | 12/2017 | Goda | G06F 9/44505 |
| 2020/0023790 | A1* | 1/2020 | Hirai | B60K 35/80 |
| 2020/0101991 | A1* | 4/2020 | Tatsumi | B60L 3/00 |
| 2020/0122757 | A1* | 4/2020 | Abrosimov | B61L 15/0018 |
| 2020/0189631 | A1* | 6/2020 | Gorman | B61L 15/0072 |

FOREIGN PATENT DOCUMENTS

| | | | | |
|---|---|---|---|---|
| JP | 2008029110 | A | 2/2008 | |
| JP | 2011100262 | A | 5/2011 | |
| JP | 2013228271 | A | 11/2013 | |
| WO | 2016117025 | A1 | 7/2016 | |
| WO | 2018/051489 | A1 | 3/2018 | |
| WO | WO-2018070388 | A1 * | 4/2018 | G05B 13/0265 |

OTHER PUBLICATIONS

Office Action issued on Nov. 10, 2020, by the Japan Patent Office in corresponding Japanese Patent Application No. 2020-544963, and an English Translation of the Office Action. (5 pages).
Office Action issued in corresponding Indian Patent Application No. 202227045984, mailed on Nov. 18, 2022, 5 pages.
Hearing Notice dated Nov. 5, 2024, issued in the corresponding Indian Patent Application No. 202227045984, 2 pages.
Office Action dated Dec. 22, 2025, issued in the corresponding German Patent Application No. 112020006789.0, 8 pages including 4 pages of machine English translation.

* cited by examiner

| Instrument List |
| --- |
| 1A |
| 1C |
| 2A |
| 2C |
| 2D |
| 2B |
| 1D |
| 1B |

| Instrument List | Necessity of Inspection |
| --- | --- |
| 1A | ○ |
| 1C | |
| 2A | ○ |
| 2C | |
| 2D | ○ |
| 2B | |
| 1D | |
| 1B | |

○ Inspection

| Operation Information T (Load Amount) | State Estimation Value x (Wear Amount) |
| --- | --- |
| T1 | x1 |
| T2 | x2 |
| · | · |
| · | · |

FIG. 11

| Instrument | Car | Area |
|---|---|---|
| A | 1 | 1 |
| B | 1 | 1 |
| C | 1 | 1 |
| D | 2 | 1 |
| E | 2 | 1 |
| F | 2 | 1 |
| G | 3 | 2 |
| H | 3 | 2 |
| I | 3 | 2 |
| J | 4 | 2 |
| K | 4 | 2 |
| L | 4 | 2 |

FIG. 12

| Instrument | Car | Area | Necessity of Inspection and Replacement |
|---|---|---|---|
| A | 1 | 1 | |
| B | 1 | 1 | ○ |
| C | 1 | 1 | ◎ |
| D | 2 | 1 | ○ |
| E | 2 | 1 | |
| F | 2 | 1 | ○ |
| G | 3 | 2 | |
| H | 3 | 2 | ◎ |
| I | 3 | 2 | ○ |
| J | 4 | 2 | ◎ |
| K | 4 | 2 | |
| L | 4 | 2 | ◎ |

○ Inspection

◎ Replacement

| Area | Predicted Value |
|---|---|
| 1 | 1 |
| 2 | 3 |

| Instrument | Car | Area | Necessity of Inspection and Replacement | Inspection and Replacement Result |
|---|---|---|---|---|
| A | 1 | 1 | | |
| B | 1 | 1 | ○ | ← |
| C | 1 | 1 | ◎ | ○ |
| D | 2 | 1 | ○ | ◎ |
| E | 2 | 1 | | |
| F | 2 | 1 | ○ | ← |
| G | 3 | 2 | | |
| H | 3 | 2 | ◎ | ← |
| I | 3 | 2 | ○ | ← |
| J | 4 | 2 | ◎ | ← |
| K | 4 | 2 | | |
| L | 4 | 2 | ◎ | ← |

○ Inspection
◎ Replacement
← Perform as Planned

FIG. 16

| Instrument | Car | Area | Necessity of Inspection and Replacement | Inspection and Replacement Result | State Estimation Value | State Measurement Value |
|---|---|---|---|---|---|---|
| A | 1 | 1 | | | | |
| B | 1 | 1 | ○ | ← | $x_B$ | $x_B'$ |
| C | 1 | 1 | ◎ | ○ | $x_C$ | $x_C'$ |
| D | 2 | 1 | ○ | ◎ | $x_D$ | $x_D'$ |
| E | 2 | 1 | | | | |
| F | 2 | 1 | ○ | ← | $x_F$ | $x_F'$ |
| G | 3 | 2 | | | | |
| H | 3 | 2 | ◎ | ← | $x_H$ | $x_H'$ |
| I | 3 | 2 | ○ | ← | $x_I$ | $x_I'$ |
| J | 4 | 2 | ◎ | ← | $x_J$ | $x_J'$ |
| K | 4 | 2 | | | | |
| L | 4 | 2 | ◎ | ← | $x_L$ | $x_L'$ |

○ Inspection
◎ Replacement
← Perform as Planned

STATE-MONITORING DEVICE AND MAINTENANCE WORK ASSISTANCE METHOD

TECHNICAL FIELD

The present disclosure relates to a state-monitoring device of an instrument mounted on a train and a maintenance work assistance method.

BACKGROUND ART

For example, Patent Literature 1 discloses a database in which a device name, a model name, a component lifetime, a lifetime operation count, and a lifetime operation time of a life-limited component or a consumable component in an electric car are registered, and a device that records the number of times of operations and an operation time of the life-limited component or the consumable component as a cumulative count, and when a cumulative count value of the number of times of operations or the operation time reaches a replacement reference value obtained from the lifetime, the lifetime operation count, or the operation time registered in the database, notifies that the corresponding component is to be replaced, using a display device.

CITATION LIST

Patent Literature

Patent Literature 1: JP 2008-29110 A

SUMMARY OF INVENTION

Technical Problem

However, since a large number of instruments are mounted on a train, there is a problem that it takes a large amount of labor to inspect a life-limited component or a consumable component used for the instrument.

The present disclosure solves the above problem, and an object thereof is to obtain a state-monitoring device and a maintenance work assistance method capable of reducing labor required for maintenance work of an instrument mounted on a train.

Solution to Problem

A state-monitoring device according to the present disclosure includes: processing circuitry configured to estimate a state of at least one instrument using operation information of a train on which the at least one instrument is mounted; store instrument arrangement information indicating arrangement of the at least one instrument in the train; and extract at least one instrument to be maintained that requires inspection or component replacement on a basis of a state estimation value of the at least one instrument, and output information regarding maintenance work in which the at least one instrument to be maintained and the instrument arrangement information are associated with each other.

Advantageous Effects of Invention

According to the present disclosure, an instrument to be maintained that requires inspection or component replacement is extracted from instruments mounted on a train on the basis of a state estimation value of the instrument, and information regarding maintenance work in which the extracted instrument to be maintained and instrument arrangement information indicating arrangement of the instruments in the train are associated with each other is output. Since the instrument to be maintained can be easily discriminated by referring to the instrument arrangement information, the maintenance work can be efficiently performed. As a result, the state-monitoring device according to the present disclosure can reduce labor required for maintenance work of the instrument mounted on the train.

BRIEF DESCRIPTION OF DRAWINGS

FIG. 11 is a diagram illustrating a third example of the instrument arrangement information.

FIG. 12 is a diagram illustrating an example of work plan information in which an instrument to be maintained and the third example of instrument arrangement information are associated with each other.

FIG. 16 is a diagram illustrating a display example 2 of the maintenance work result.

DESCRIPTION OF EMBODIMENTS

First Embodiment

Figure 1:
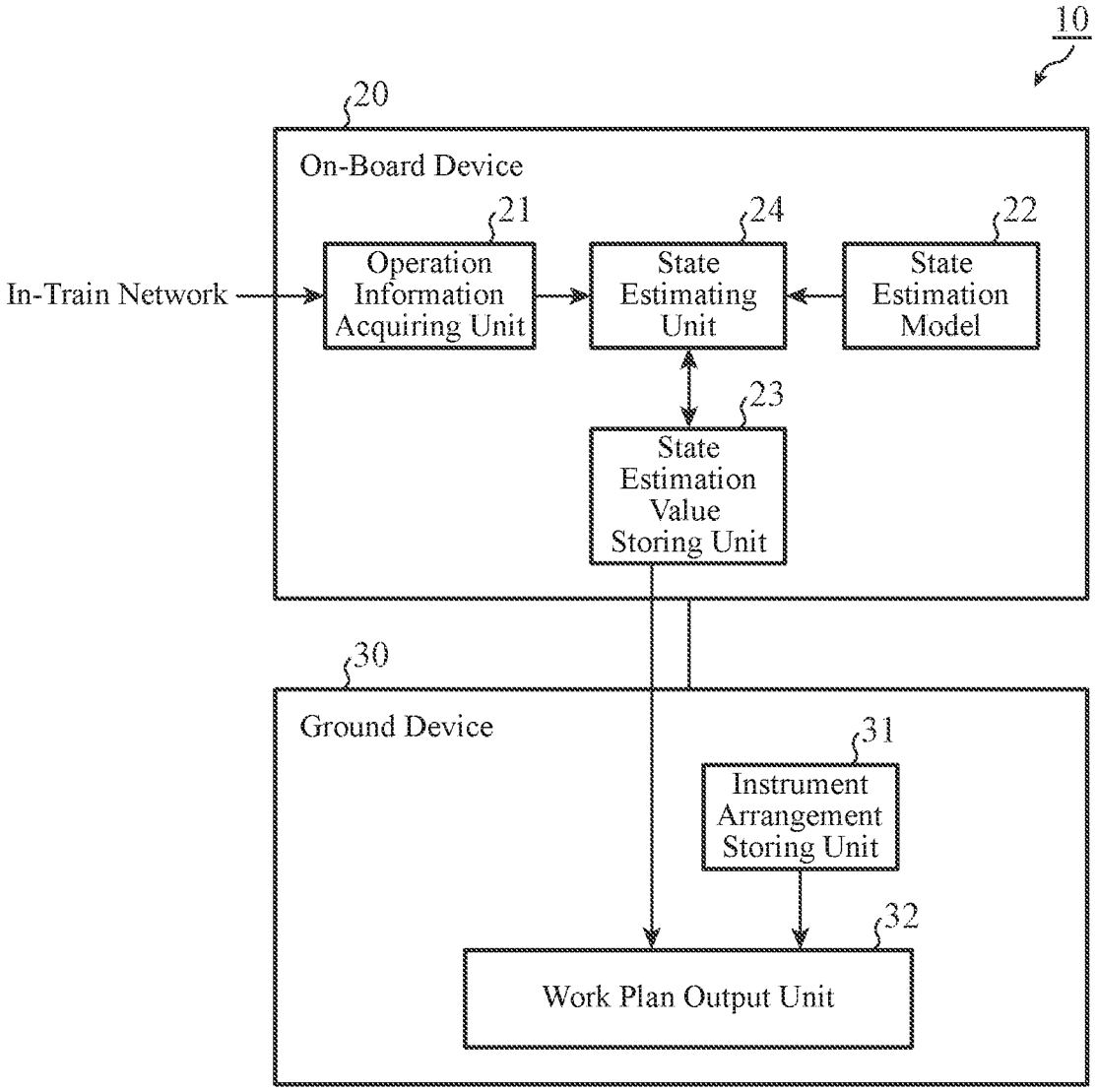
FIG. 1 is a block diagram illustrating a configuration example of a state-monitoring device according to a first embodiment.

FIG. 1 is a block diagram illustrating a configuration example of a state-monitoring device 10 according to a first embodiment. The state-monitoring device 10 monitors states of a plurality of instruments mounted on the train, and outputs information regarding maintenance work of the instruments on the basis of a monitoring result of the states of the instruments. The instruments of the state-monitoring target are instruments affected by the operation of the train, and are, for example, brake devices having a brake controlling shoe as a component.

As illustrated in FIG. 1, the state-monitoring device 10 includes an on-board device 20 mounted on a train and a ground device 30 disposed in a maintenance work office or carried by a maintenance worker. The on-board device 20 is a computer including a processing device, a storage device, and an input and output device. Similarly to the on-board device 20, the ground device 30 is a computer including a processing device, a storage device, and an input and output device. For example, the ground device 30 may be an office computer including a display device, a keyboard, a mouse, and a printer, or may be a portable tablet computer.

Although FIG. 1 illustrates the state-monitoring device 10 in which the on-board device 20 and the ground device 30 are connected on a one-to-one basis, the ground device 30 may be connected to a plurality of on-board devices 20 mounted on a plurality of cars, respectively, via a network. Further, in consideration that a plurality of maintenance workers use the state-monitoring device 10, the state-monitoring device 10 may have a configuration in which a plurality of on-board devices 20 and a plurality of ground devices 30 are connected.

The on-board device 20 includes an operation information acquiring unit 21, a state estimation model 22, a state estimation value storing unit 23, and a state estimating unit 24. The ground device 30 includes an instrument arrangement storing unit 31 and a work plan output unit 32.

The operation information acquiring unit 21 acquires operation information of a train on which instruments are mounted. For example, the operation information acquiring unit 21 acquires operation information at any time or at regular intervals through an in-train network. The train operation information is information indicating an operation state of the train. The operation information includes, for example, information indicating the driving operation of the train, the speed of the car, and the braking force at each time. The information indicating the driving operation includes a notch position of the train and the like.

The state estimation model 22 determines a function for estimating a state of an instrument using operation information of the train and information indicating a past state of the instrument mounted on the train. For example, the state estimation model 22 calculates, using the operation information at each time for estimating the state of the instrument, a change amount of the state estimation value of the instrument at preceding and subsequent times and calculates the state estimation value of the instrument at the estimation target time using the calculated change amount. The instrument state estimation processing is processing that is repeatedly and automatically executed during operation of the train and estimates the state of the instrument at the time of execution.

The state estimation value storing unit 23 is a storage unit that stores the state estimation value of the instrument estimated by the state estimating unit 24. Note that numerical representation of the state of the instrument is a state value, and estimation of the state value is a state estimation value. The state estimation value of the instrument is obtained by quantifying the degree of change in the state of the instrument with the lapse of time, and the value at the time when the instrument is subjected to component replacement is "0". For example, since the brake controlling shoe is gradually worn by the operation of the train, the wear amount of the brake controlling shoe over time expressed in millimeters can be defined as the state value of the brake device. In addition, a replacement reference value is set for each instrument. When the state value of the instrument reaches the replacement reference value, it is determined that the component of the instrument is at end of life and needs to be replaced.

The state estimating unit 24 estimates the state of the instrument mounted on the train using the operation information of the train acquired by the operation information acquiring unit 21, and outputs the state estimation value to the state estimation value storing unit 23. For example, the state estimating unit 24 calculates the state estimation value of the instrument using the operation information of the train and the state estimation model 22. The state estimation processing is periodically performed once a day, once a week, or the like. The state estimation processing may be performed in conjunction with occurrence of a specific event such as a brake operation.

In a case where a time at which a component is replaced last time is $t_0$ and the state estimation value of the instrument including the component at the time $t_0$ is $x_0$, a state estimation value $x_i$ (i=0, . . . , n) of the instrument at a time $t_i$ (i=1, . . . , n) at which the state estimation processing of the instrument is performed is expressed by the following Formula (1). In the following Formula (1), $\Delta x_i$ is a change amount of the state estimation value of the instrument from the time $t_{i-1}$ to the time $t_i$.

$$x_i=x_{i-1}+\Delta x_i x_0=0 \tag{1}$$

The state estimation model 22 inputs the state $x_{i-1}$ of the instrument at the time $t_{i-1}$ and the operation information $T_i$ of the train from the time $t_{i-1}$ to the time $t_i$, and calculates the change amount $\Delta x_i$ using the function shown in the following Formula (2).

$$\Delta x_i=M(x_{i-1},T_i) \tag{2}$$

The following Formula (3) is derived from the above Formula (1) and the above Formula (2). The state estimating unit 24 calculates the state estimation value $x_i$ of the instrument at the time $t_i$ by using the following Formula (3).

$$x_i = x_{i-1} + M(x_{i-1}, T_i) = \sum_{i=1}^{n} M(x_{i-1}, T_i) \tag{3}$$

The instrument arrangement storing unit 31 is a storage unit that stores instrument arrangement information indicating arrangement of instruments in the cars of the train. The instrument arrangement information is information in a graphic form or a table form in which arrangement of instruments in the car can be visually recognized, and is, for example, information indicating arrangement positions of a plurality of instruments.

On the basis of the state estimation value of the instrument stored in the state estimation value storing unit 23, the work plan output unit 32 extracts an instrument to be maintained that requires inspection or component replacement from a plurality of instruments mounted on the train, and outputs information regarding maintenance work in which the instrument to be maintained and the instrument arrangement information are associated with each other. The work plan output unit 32 outputs information regarding the maintenance work to, for example, a display device or a printer. The information regarding the maintenance work is displayed on the screen of the display device and printed by the printer. The information regarding the maintenance work is information in a graphic form or a table form in which the instrument to be maintained in the car and the arrangement position thereof can be visually recognized.

Figure 2:
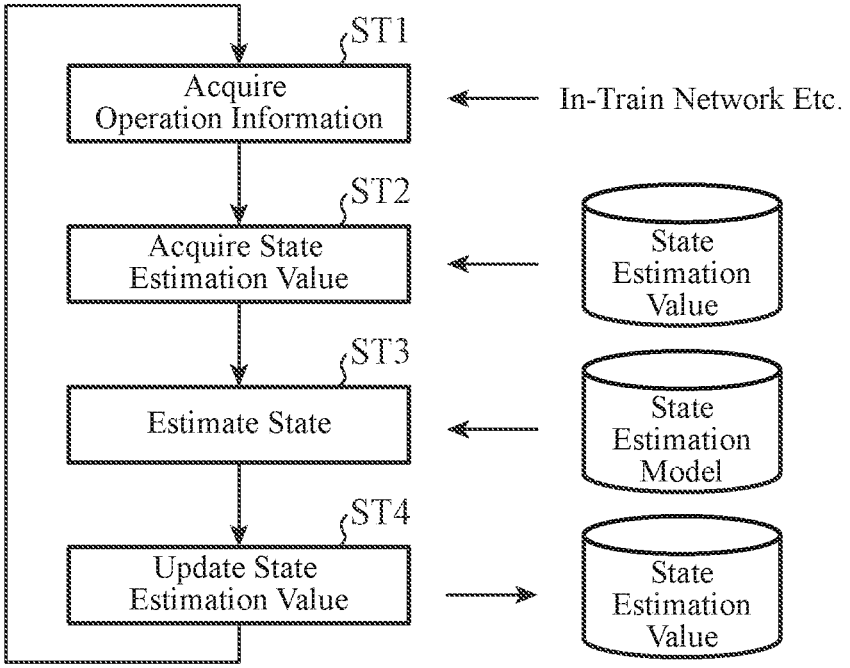
FIG. 2 is a flowchart illustrating state estimation processing in the first embodiment.

FIG. 2 is a flowchart illustrating the state estimation processing in the first embodiment, and illustrates the state estimation processing of calculating the state estimation value $x_i$ of the instrument at the time $t_i$. The operation information acquiring unit 21 acquires operation information of the train through the in-train network (step ST1). For example, the operation information acquiring unit 21 acquires operation information indicating the driving operation, the speed, and the braking force of the train from the time $t_{i-1}$ to the time $t_i$, and outputs the operation information to the state estimating unit 24.

The state estimating unit 24 acquires the past state estimation value of the instrument stored in the state estimation value storing unit 23 (step ST2). For example, the state estimating unit 24 reads and acquires the state estimation value $x_{i-1}$ of the instrument at the time $t_{i-1}$ stored in the state estimation value storing unit 23.

Next, the state estimating unit 24 calculates a state estimation value of the instrument using the state estimation model 22 (step ST3). When the operation information $T_i$ from the time $t_{i-1}$ to the time $t_i$ is input, the state estimation model 22 calculates the change amount $\Delta x_i$ from the time $t_{i-1}$ to the time $t_i$ in accordance with the above Formula (2). The state estimating unit 24 calculates the state estimation value $x_i$ by adding the change amount $\Delta x_i$ to the state estimation value $x_{i-1}$ at the time $t_{i-1}$ in accordance with the above Formula (1).

The state estimating unit 24 updates the state estimation value $x_{i-1}$ at the time $t_i$ stored in the state estimation value storing unit 23 with the state estimation value $x_i$ calculated this time (step ST4). As a result, the newly estimated state estimation values are sequentially stored in the state estimation value storing unit 23.

For example, in a case where the instrument of the state estimation target is a brake device, the brake controlling shoe included in the brake device is gradually worn every time the brake operation of the car is performed. Therefore, when the brake controlling shoe is worn by a certain amount or more, it is necessary to replace the brake controlling shoe with a new brake controlling shoe. Here, a difference in thickness between a new brake controlling shoe and a worn brake controlling shoe is defined as a wear amount, and it is assumed that this wear amount is a state value of the brake device.

The state estimation model 22 estimates the change amount of the state value of the brake device on the basis of the operation information. It is assumed that the wear amount of the brake controlling shoe is proportional to a load amount (hereinafter, referred to as a brake load amount) applied to the brake controlling shoe by the brake operation. The state estimation model 22 calculates a change amount $\Delta x_i$ in accordance with a function shown in the following Formula (4). In the following Formula (4), "a" is a parameter determined for each state estimation model 22, and $T_i$ is operation information from the time $t_{i-1}$ to the time $t_i$. In addition, the brake load amount is acquired as the operation information $T_i$. The brake load amount can be calculated, for example, by integrating the product of a brake pressure and a car speed.

$$\Delta x_i = M(x_{i-1}, T_i) = aT_i \tag{4}$$

The following Formula (5) is derived from the above Formula (3) and the above Formula (4). The state estimating unit 24 calculates a state estimation value (wear amount) $x_i$ at the time $t_i$ in accordance with the following Formula (5) using the operation information $T_i$. In order to estimate the wear amount $x_i$, it is necessary to appropriately determine the parameter a.

$$x_i = a\sum_{i=1}^{n} T_i \tag{5}$$

Figure 3:
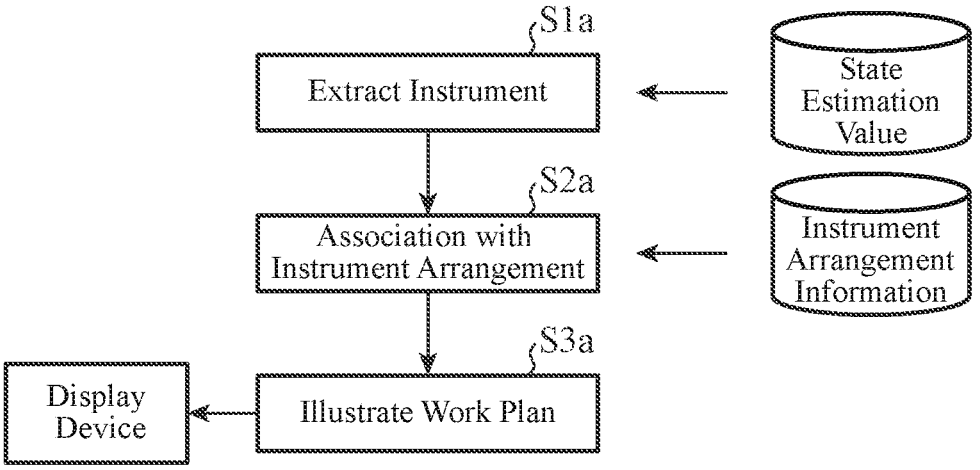
FIG. 3 is a flowchart illustrating work plan output processing in the first embodiment.

FIG. 3 is a flowchart illustrating work plan output processing in the first embodiment, which is processing before periodic maintenance work is performed on an instrument. On the basis of the state estimation value of the instrument stored in the state estimation value storing unit 23, the work plan output unit 32 extracts an instrument to be maintained that requires inspection or component replacement from a plurality of instruments mounted on the train (step ST1*a*). For example, in a case where the state estimation value of the instrument is x, the replacement reference value set for the instrument is $x_e$, and the error between the state value of the instrument and the state estimation value is m, if the state estimation value x exceeds a value obtained by subtracting the error m from the replacement reference value $x_e$, the state value may exceed the replacement reference value $x_e$. The inspection reference value $x_c$, which is a criterion for determining whether or not inspection of the instrument is necessary, is calculated in accordance with the following Formula (6).

$$x_c = x_e - m \tag{6}$$

Next, the work plan output unit 32 classifies each of the instruments mounted on the train as "inspection unnecessary", "inspection necessary", or "replacement necessary" on the basis of the comparison result between the state estimation value x, the replacement reference value $x_e$, and the inspection reference value $x_c$. When the state estimation value x of the instrument is equal to or less than the inspection reference value $x_c$, the instrument does not need to be inspected, and thus is classified into a group (A). When the state estimation value x of the instrument is equal to or more than the inspection reference value $x_c$, the inspection is necessary. However, when the state estimation value x is less than the replacement reference value $x_e$, there is a high possibility that the replacement of the component is unnecessary. Therefore, the instrument satisfying this condition is classified into a group (B). When the state estimation value x of the instrument is equal to or more than the replacement reference value $x_e$, there is a high possibility that the instrument is an instrument that requires inspection and component replacement, and thus the instrument satisfying this condition is classified into a group (C). The work plan output unit 32 extracts the instrument classified into the groups (B) and (C) as the instrument to be maintained.

Figure 4A:
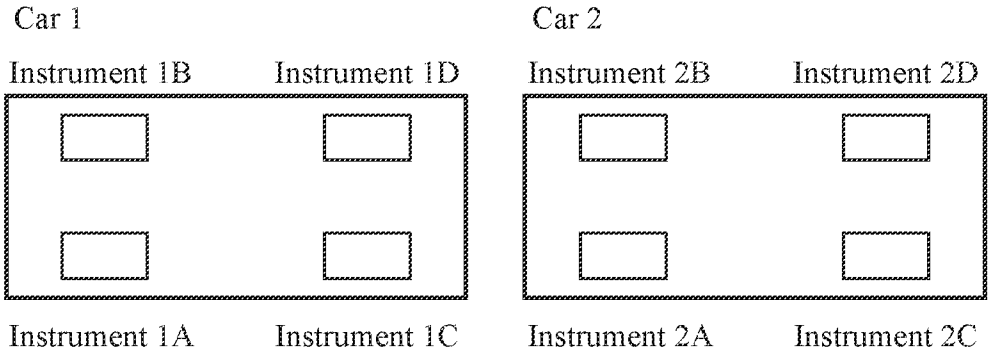
FIG. 4A is a diagram illustrating a first example of instrument arrangement information.
Figure 4B:
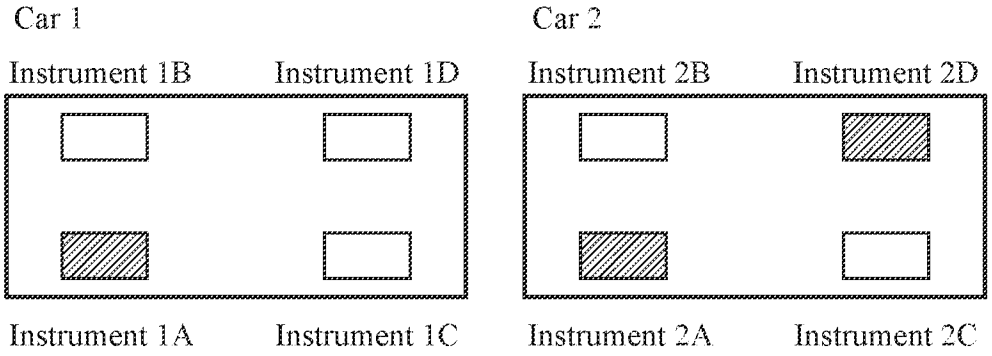
FIG. 4B is a diagram illustrating an example of information in which an instrument to be maintained and the first example of the instrument arrangement information are associated with each other.
Figure 4B:
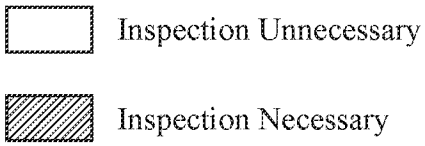

(A) Inspection unnecessary $x \leq x_c$ (B) Inspection necessary $x_c \leq x < x_e$ (C) Replacement necessary $x_e \leq x$ The work plan output unit 32 associates the instrument to be maintained that has been extracted in step ST1*a* with the instrument arrangement information stored in the instrument arrangement storing unit 31 (step ST2*a*). FIG. 4A is a diagram illustrating a first example of the instrument arrangement information, and FIG. 4B is a diagram illustrating an example of the work plan information in which the instrument to be maintained is associated with the first example of the instrument arrangement information. The instrument arrangement storing unit 31 stores instrument arrangement information visually recognizable in a graphic form or a table form.

FIG. 4A is a diagram illustrating the first example of the instrument arrangement information, and illustrates the instrument arrangement information expressed in a plan view. The instrument arrangement information of FIG. 4A indicates that four instruments 1A to 1D and four instruments 2A to 2D to be maintained are arranged in each car of a two-car train. FIG. 4B is a diagram illustrating an example of work plan information in which the instruments 1A to 1D and 2A to 2D are associated with the instrument arrangement information of FIG. 4A.

The work plan output unit 32 extracts, for example, the instrument 1A, the instrument 2A, and the instrument 2D as instruments that require inspection from the instruments 1A to 1D arranged in the car 1 and the instruments 2A to 2D arranged in the car 2. As illustrated in FIG. 4B, the work plan output unit 32 associates the instrument 1A, the instrument 2A, and the instrument 2D to be inspected with the instrument arrangement information of FIG. 4A by generating the display information illustrated in FIG. 4B in which the colors of the symbols of the instrument 1A, the instrument 2A, and the instrument 2D in the instrument arrangement information illustrated in FIG. 4A are changed.

Figures 5A, 5B, 6, 7:
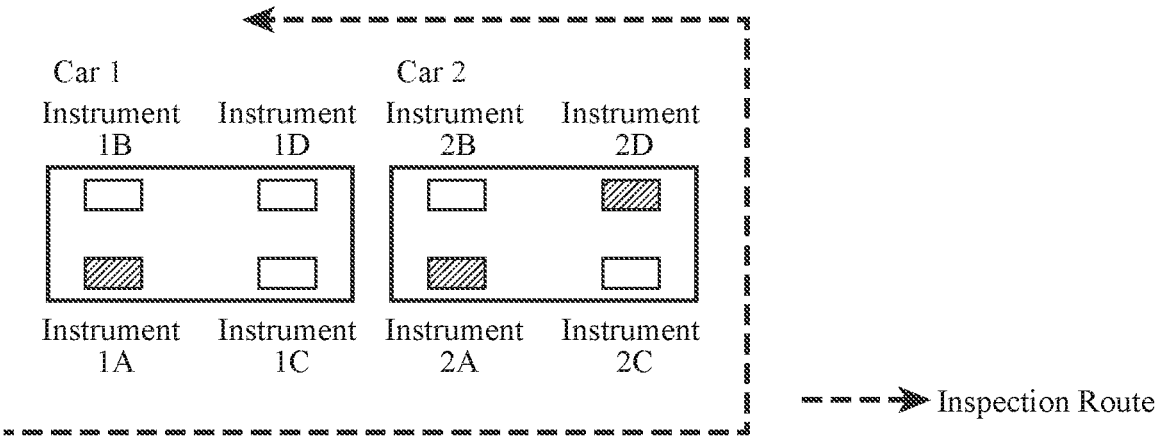
FIG. 5A is a diagram illustrating a second example of the instrument arrangement information.
FIG. 5B is a diagram illustrating an example of work plan information in which the instrument to be maintained and the second example of the instrument arrangement information are associated with each other.
FIG. 6 is a diagram illustrating an example of information in which instruments to be maintained are arranged in order along an inspection route.
FIG. 7 is an explanatory diagram illustrating a relationship between operation information and a state estimation value.

FIG. 5A is a diagram illustrating a second example of the instrument arrangement information, and illustrates the instrument arrangement information expressed in a table format. The instrument arrangement information of FIG. 5A indicates that eight instruments 1A to 1D and 2A to 2D to be inspected are arranged in the order along the inspection route in the car. FIG. 5B is a diagram illustrating an example of information in which the instruments 1A to 1D and 2A to 2D are associated with the instrument arrangement information of FIG. 5A. As in the case of FIG. 4B, the work plan output unit 32 extracts the instrument 1A, the instrument 2A, and the instrument 2D as instruments that require inspection.

The work plan output unit 32 provides, for example, a setting entry named "Necessity of Inspection" for setting necessity of inspection of an instrument for table data indicated by the instrument arrangement information in FIG. 5A. The work plan output unit 32 associates the instrument 1A, the instrument 2A, and the instrument 2D to be inspected with the instrument arrangement information of FIG. 5A by generating information in which a circle symbol indicating that the instrument needs to be inspected is set for portions corresponding to the instrument 1A, the instrument 2A, and the instrument 2D in the setting entry.

Next, the work plan output unit 32 causes the display device to display information in which the instrument to be maintained is associated with the instrument arrangement information as work plan information (step ST3*a*). For example, the work plan output unit 32 outputs the information in a graphic form illustrated in FIG. 4B or the information in a table form illustrated in FIG. 5B to the display device. The display device displays the information in a graphic form illustrated in FIG. 4B or the information in a table form illustrated in FIG. 5B on the screen. These pieces of information may be printed using a printer.

For example, the maintenance worker can easily specify the instrument to be inspected from the plurality of instruments arranged in the car by referring to the symbol whose color has been changed in the information in the graphic form illustrated in FIG. 4B. In addition, the maintenance worker can easily specify the instrument to be inspected from the plurality of instruments arranged in the car by referring to the portion in which the circle symbol is set in the information in the table form illustrated in FIG. 5B.

FIG. 6 is a diagram illustrating an example of the work plan information in which the instruments 1A to 1D and 2A to 2D are arranged in the order along the inspection route, and represents, in a graphic form, information in which the instruments 1A to 1D and 2A to 2D are associated with the instrument arrangement information of FIG. 5A. The work plan output unit 32 generates the work plan information illustrated in FIG. 6 and outputs the work plan information to the display device. In the work plan information illustrated in FIG. 6, the instruments to be inspected are displayed in the order along the inspection route. The maintenance worker can reliably inspect the instruments to be inspected by performing the inspection work along the inspection route indicated by the work plan information.

Although the work plan information illustrated in FIG. 6 illustrates a case where the inspection route is fixed regardless of the arrangement of the instruments to be inspected, the work plan output unit 32 may change the existing inspection route depending on the arrangement of the instruments to be inspected. For example, when the arrangement position of the instruments to be inspected is specified on the basis of the instrument arrangement information, the work plan output unit 32 searches for an inspection route on which maintenance work can be most efficiently performed on the instruments to be inspected, and changes the inspection route to the route of the search result in a case where the route of the search result is different from the existing route. As an inspection route on which maintenance work can be most efficiently performed on the instruments to be inspected, there is a route that reaches the instrument to be inspected by the shortest distance or in the shortest time. The work plan output unit 32 generates work plan information in which the instruments to be inspected are arranged in the order along the changed inspection route, and displays the work plan information on the display device.

A method of sequentially executing the processing illustrated in FIG. 2 and the processing illustrated in FIG. 3 and outputting the work plan information is a maintenance work assistance method according to the first embodiment. The maintenance worker can discriminate the instrument to be maintained on the basis of the instrument arrangement information by referring to the work plan information output by the maintenance work assistance method according to the first embodiment. As a result, it is possible to reduce labor required for maintenance work of the instruments mounted on the train.

The function $M(x_{i-1}, T_i)$ of the state estimation model 22 needs to be appropriately determined before the operation of the state-monitoring device 10 is started. This processing is called construction of a state estimation model. The state estimation model 22 is constructed by determining the parameter a in M $(x_{i-1}, T_i)=aT_i$ which is the function expressed in the above Formula (4). Two methods are conceivable as a method of constructing the state estimation model 22.

A first method is a method of constructing the state estimation model 22 on the basis of the physical law indicating the relationship between the operation information of the train and the state change of the instrument. For example, when a physical law regarding the relationship between the brake load amount and the wear amount of the brake controlling shoe is known, the parameter a in the above Formula (4) can be determined using this physical law.

A second method is a method of collecting actual measurement data indicating a relationship between operation information of a train and a state change of an instrument and constructing the state estimation model 22 on the basis of the collected data. For example, the train on which the on-board device 20 is mounted is caused to travel while recording the time-series data of the brake pressure and the car speed as the operation information. The brake load amount that changes from moment to moment is calculated on the basis of the time-series data of the brake pressure and the car speed. Furthermore, by measuring the thickness of the brake controlling shoe every several weeks, it is possible to record the difference in thickness from the time when the brake controlling shoe is new as the wear amount.

FIG. 7 is an explanatory diagram illustrating the relationship between the operation information and the state estimation value, and illustrates the relationship between the brake load amount as the operation information and the state estimation value x obtained by estimating the wear amount of the brake controlling shoe. The value of the parameter a can be determined by the least squares method using the data illustrated in FIG. 7. By using the state estimation model 22 defining the value of the parameter a, the state estimation value (wear amount) $x_i$ at the time $t_i$ can be estimated in accordance with the above Formula (5).

Figure 8:
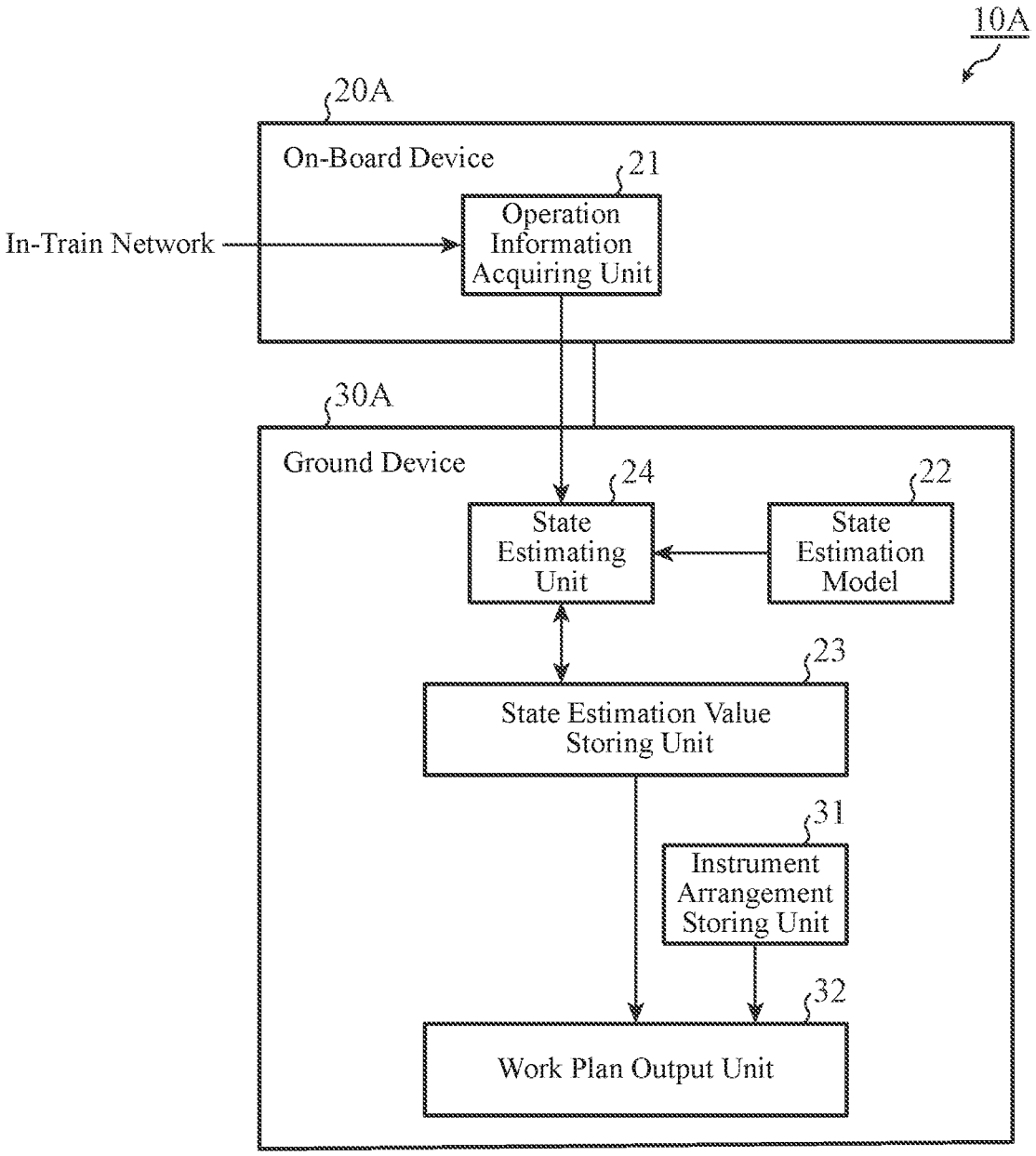
FIG. 8 is a block diagram illustrating a configuration of a modification of the state-monitoring device according to the first embodiment.

FIG. 8 is a block diagram illustrating a configuration of a state-monitoring device 10A which is a modification of the state-monitoring device 10. The state-monitoring device 10A includes an on-board device 20A mounted on a train and a ground device 30A disposed in a maintenance work office or carried by a maintenance worker. Note that although FIG. 8 illustrates the state-monitoring device 10A in which the on-board device 20A and the ground device 30A are connected on a one-to-one basis, the ground device 30A may be connected to a plurality of on-board devices 20A mounted on a plurality of cars, respectively, via a network. Furthermore, considering that a plurality of maintenance workers simultaneously use the state-monitoring device 10A, the state-monitoring device 10A may have a configuration in which a plurality of on-board devices 20A and a plurality of ground devices 30A are connected.

In the state-monitoring device 10A, the on-board device 20A includes an operation information acquiring unit 21. The ground device 30A includes a state estimation model 22, a state estimation value storing unit 23, a state estimating unit 24, an instrument arrangement storing unit 31, and a work plan output unit 32. The operation information acquiring unit 21 provided for each car acquires operation information for each car and outputs the operation information to the ground device 30A. The state estimation model 22 is constructed for each car and each instrument. On the basis of the state estimation value of the instrument stored in the state estimation value storing unit 23, the work plan output unit 32 extracts an instrument to be maintained that requires inspection or component replacement from a plurality of instruments mounted on the train, and outputs information regarding maintenance work in which the instrument to be maintained and the instrument arrangement information are associated with each other. As a result, the state-monitoring device 10A makes it possible to reduce labor required for maintenance work of the instruments mounted on the train.

Figure 9A:
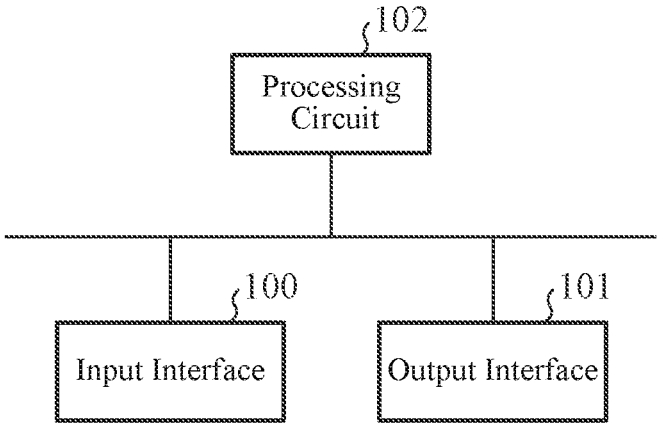
FIG. 9A is a block diagram illustrating a hardware configuration for implementing the functions of the state-monitoring device according to the first embodiment.
Figure 9B:
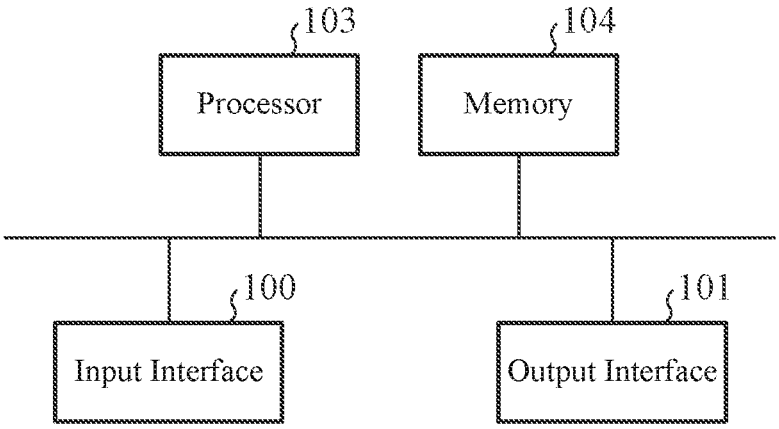
FIG. 9B is a block diagram illustrating a hardware configuration for executing software for implementing the functions of the state-monitoring device according to the first embodiment.

FIG. 9A is a block diagram illustrating a hardware configuration for implementing the functions of the state-monitoring device 10, and FIG. 9B is a block diagram illustrating a hardware configuration for executing software for implementing the functions of the state-monitoring device 10. In FIGS. 9A and 9B, an input interface 100 is, for example, an interface that relays operation information acquired from the car by the operation information acquiring unit 21. An output interface 101 is, for example, an interface that relays the work plan information output from the work plan output unit 32 to the display device.

The functions of the operation information acquiring unit 21, the state estimation model 22, the state estimation value storing unit 23, the state estimating unit 24, the instrument arrangement storing unit 31, and the work plan output unit 32 in the state-monitoring device 10 are implemented by a processing circuit. That is, the state-monitoring device 10 includes a processing circuit for executing each processing illustrated in FIGS. 2 and 3. The processing circuit may be dedicated hardware or a central processing unit (CPU) that executes a program stored in a memory.

In a case where the processing circuit is a processing circuit 102 of dedicated hardware shown in FIG. 9A, the processing circuit 102 corresponds, for example, to a single circuit, a composite circuit, a programmed processor, a parallel-programmed processor, an application specific integrated circuit (ASIC), a field-programmable gate array (FPGA), or a combination thereof. The functions of the operation information acquiring unit 21, the state estimation model 22, the state estimation value storing unit 23, the state estimating unit 24, the instrument arrangement storing unit 31, and the work plan output unit 32 in the state-monitoring device 10 may be implemented by separate processing circuits, or these functions may be collectively implemented by one processing circuit.

When the processing circuit is a processor 103 illustrated in FIG. 9B, the functions of the operation information acquiring unit 21, the state estimation model 22, the state estimation value storing unit 23, the state estimating unit 24, the instrument arrangement storing unit 31, and the work plan output unit 32 in the state-monitoring device 10 are implemented by software, firmware, or a combination of software and firmware. Note that, software or firmware is written as a program and stored in a memory 104.

The processor 103 reads and executes the program stored in the memory 104, thereby implementing the functions of the operation information acquiring unit 21, the state estimation model 22, the state estimation value storing unit 23, the state estimating unit 24, the instrument arrangement storing unit 31, and the work plan output unit 32 in the state-monitoring device 10. For example, the state-monitoring device 10 includes the memory 104 that stores a program that, when executed by the processor 103, results in execution of each processing illustrated in FIGS. 2 and 3. These programs cause a computer to execute procedures or methods performed by the operation information acquiring unit 21, the state estimation model 22, the state estimation value storing unit 23, the state estimating unit 24, the instrument arrangement storing unit 31, and the work plan output unit 32. The memory 104 may be a computer-readable storage medium storing a program for causing a computer to function as the operation information acquiring unit 21, the state estimation model 22, the state estimation value storing unit 23, the state estimating unit 24, the instrument arrangement storing unit 31, and the work plan output unit 32.

Examples of the memory 104 correspond to a nonvolatile or volatile semiconductor memory, such as a random access memory (RAM), a read only memory (ROM), a flash memory, an erasable programmable read only memory (EPROM), or an electrically-EPROM (EEPROM), a magnetic disk, a flexible disk, an optical disk, a compact disk, a mini disk, and a DVD.

A part of the functions of the operation information acquiring unit 21, the state estimation model 22, the state estimation value storing unit 23, the state estimating unit 24, the instrument arrangement storing unit 31, and the work plan output unit 32 in the state-monitoring device 10 may be implemented by dedicated hardware, and a part thereof may be implemented by software or firmware. For example, the operation information acquiring unit 21 implements functions by the processing circuit 102 that is dedicated hardware, and the state estimation model 22, the state estimation value storing unit 23, the state estimating unit 24, the instrument arrangement storing unit 31, and the work plan output unit 32 implement functions by the processor 103 reading and executing programs stored in the memory 104. Thus, the processing circuit can implement the above functions by hardware, software, firmware, or a combination thereof.

Figure 10:
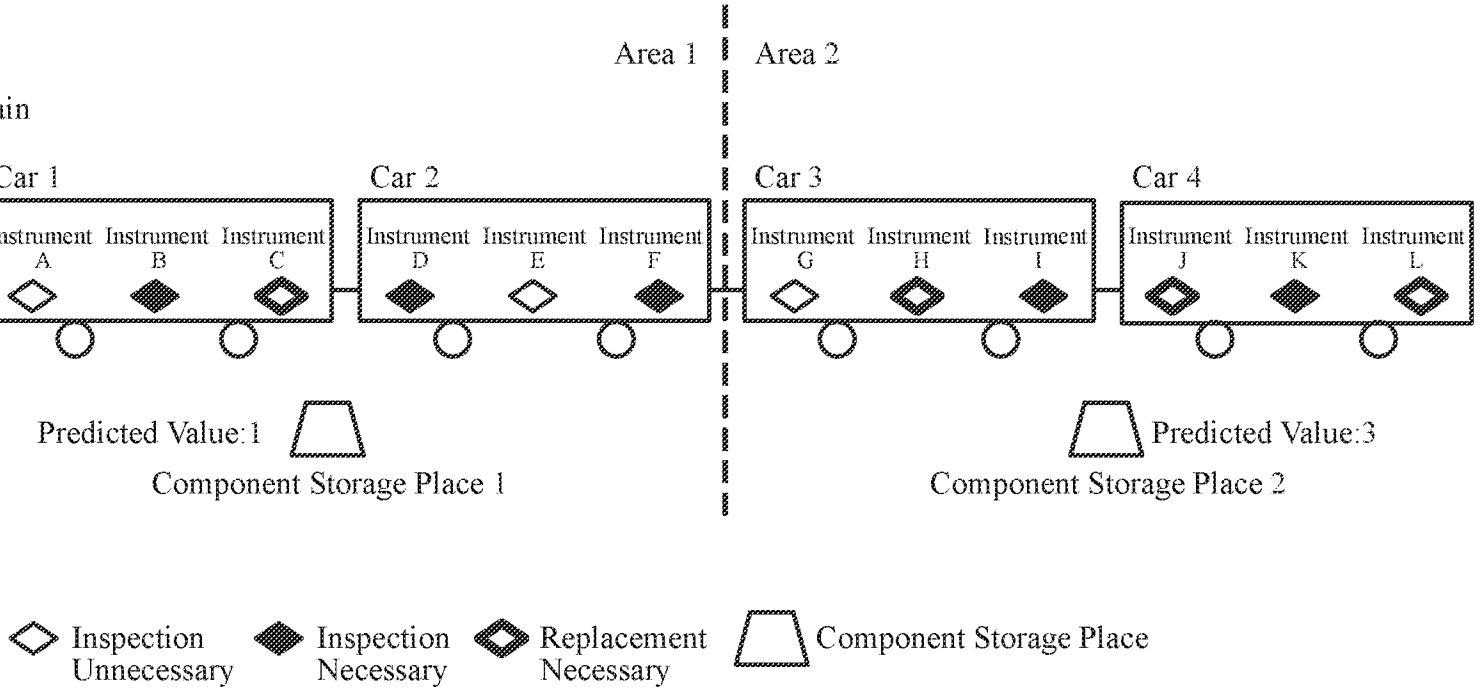
FIG. 10 is a diagram illustrating an example of work plan information according to the first embodiment.

FIG. 10 is a diagram illustrating an example of work plan information according to the first embodiment, and illustrates work plan information in which the number of components to be replaced predicted for an instrument that requires component replacement is aggregated for each area in which the instrument is disposed. FIG. 11 is a diagram illustrating a third example of the instrument arrangement information. The work plan information illustrated in FIG. 10 describes that three instruments are arranged in each car of a four-car train. The inspection place is divided into an area 1 and an area 2, and each area is provided with a component storage place (a component storage place 1 and a component storage place 2) in which a replacement component is disposed.

In the instrument arrangement storing unit 31, for example, as illustrated in FIG. 11, instrument arrangement information in a table format is stored. In the instrument arrangement information, in which of the area 1 or the area 2 the instruments A to L are arranged and on which of the cars 1 to 4 the instruments A to L are mounted are set. The work plan output unit 32 classifies each of the instruments A to L mounted on the cars 1 to 4 as "inspection unnecessary", "inspection necessary", or "replacement necessary" on the basis of the comparison result between the state estimation value x of the instrument, the replacement reference value $x_e$, and the inspection reference value $x_c$.

The work plan output unit 32 extracts an instrument that requires component replacement from the instruments classified as "inspection necessary", or "replacement necessary", and predicts the number of instruments that require component replacement for each area. The instrument that requires component replacement in the area 1 is the instrument C, and the instruments that require component replacement in the area 2 are the instrument H, the instrument J, and the instrument L. The work plan output unit 32 predicts that the number of instruments estimated to require component replacement on the basis of the state estimation value x is one in the area 1 and is three in the area 2.

Subsequently, the work plan output unit 32 generates work plan information in a graphic form illustrated in FIG. 10 by associating the predicted number of instruments with the instrument arrangement information. The work plan information generated by the work plan output unit 32 is displayed on a screen by a display device or output in the form of paper by a printer. FIG. 12 is a diagram illustrating an example of the work plan information in which the instrument to be maintained is associated with the third example of the instrument arrangement information. The work plan information in the table form illustrated in FIG. 12 is information in which the necessity of inspection or component replacement of the instrument and a predicted value for each area of the number of instruments that require component replacement are associated with the instrument arrangement information illustrated in FIG. 10.

The work plan output unit 32 provides a first setting entry named "Necessity of Inspection and Replacement" for setting necessity of inspection of an instrument and component replacement with respect to table data indicated by the instrument arrangement information of FIG. 10, and further provides a second setting entry for setting a predicted value for each area of the number of instruments that require component replacement. The work plan output unit 32 sets a circle symbol indicating that the instrument needs to be inspected for portions corresponding to the instrument A, the instrument D, the instrument F, and the instrument I that require inspection in the first setting entry, sets a double circle symbol indicating that the instrument needs component replacement for portions corresponding to the instrument C, the instrument H, the instrument J, and the instrument L that require component replacement in the first setting entry, and generates work plan information in which the number of instruments that require component replacement is set for each area in the second setting entry. The work plan information generated by the work plan output unit 32 is displayed on a screen by a display device or output in the form of paper by a printer.

Since the work plan information illustrated in FIGS. 10 and 12 describes the predicted value for each area of the number of instruments that require component replacement, the maintenance worker can dispose the replacement component in the component storage place of each area. When there is no prediction information on the number of instruments that require component replacement, a larger number of replacement components are arranged in the component storage place, or replacement components are carried into the component storage place at a time point when it is determined that the component replacement is necessary by inspecting the instruments. On the other hand, when there is prediction information of the number of instruments that require component replacement, it is possible to arrange a number of replacement components close to the required number in the component storage place before starting the inspection. As a result, the number of components excessively transported from the warehouse to the component storage place can be reduced. Furthermore, the frequency of transporting the components from the warehouse after the start of the inspection is reduced, and the time required for the transportation work is shortened. Furthermore, it is possible to dispose a replacement component in a component storage place in the vicinity of an instrument that requires component replacement among a plurality of component storage places, and a moving time between the component storage place and the work site is shortened.

As described above, in the state-monitoring device 10 or 10A according to the first embodiment, the work plan output unit 32 extracts an instrument to be maintained that requires inspection or component replacement from instruments mounted on the train on the basis of the state estimation value of the instruments, and outputs information regarding maintenance work in which the extracted instrument to be maintained is associated with instrument arrangement information indicating arrangement of instruments in the train. Since the instrument to be maintained can be easily discriminated by referring to the instrument arrangement information, the maintenance work can be efficiently performed. As a result, the state-monitoring device 10 or 10A can reduce labor required for maintenance work of instruments mounted on the train.

In the maintenance work of the instrument, an ideal time for component replacement of the instrument is immediately before the end of the life of the component. If the component replacement can be performed immediately before the end of the life of the component, the use period of the component can be lengthened as much as possible while avoiding defects due to time degradation of the component. In order to determine that a component included in an instrument is in a state immediately before the end of its life, it is necessary to repeatedly inspect the instrument at short intervals. However, since many instruments are mounted on a train, it takes a lot of labor to repeatedly inspect all the instruments at short intervals. On the other hand, since the state-monitoring device 10 or 10A can easily discriminate the instrument to be maintained by referring to the instrument arrangement information, it is possible to repeatedly perform the maintenance work of all the instruments at short intervals.

In addition, in the state-monitoring device 10 or 10A according to the first embodiment, the work plan output unit 32 outputs display information in which the instruments to be maintained are arranged in the order along the inspection route on the basis of the instrument arrangement information. The instruments to be inspected can be reliably inspected by performing the inspection work along the inspection route indicated by the work plan information.

Furthermore, in the state-monitoring device 10 or 10A according to the first embodiment, the work plan output unit 32 predicts the number of instruments that require component replacement for each area in which the instruments are arranged, and outputs information including the predicted number of instruments for each area. It is possible to dispose a replacement component in advance in the vicinity of an instrument that requires component replacement, and it is possible to reduce man-hours of maintenance work.

Second Embodiment

Figure 13:
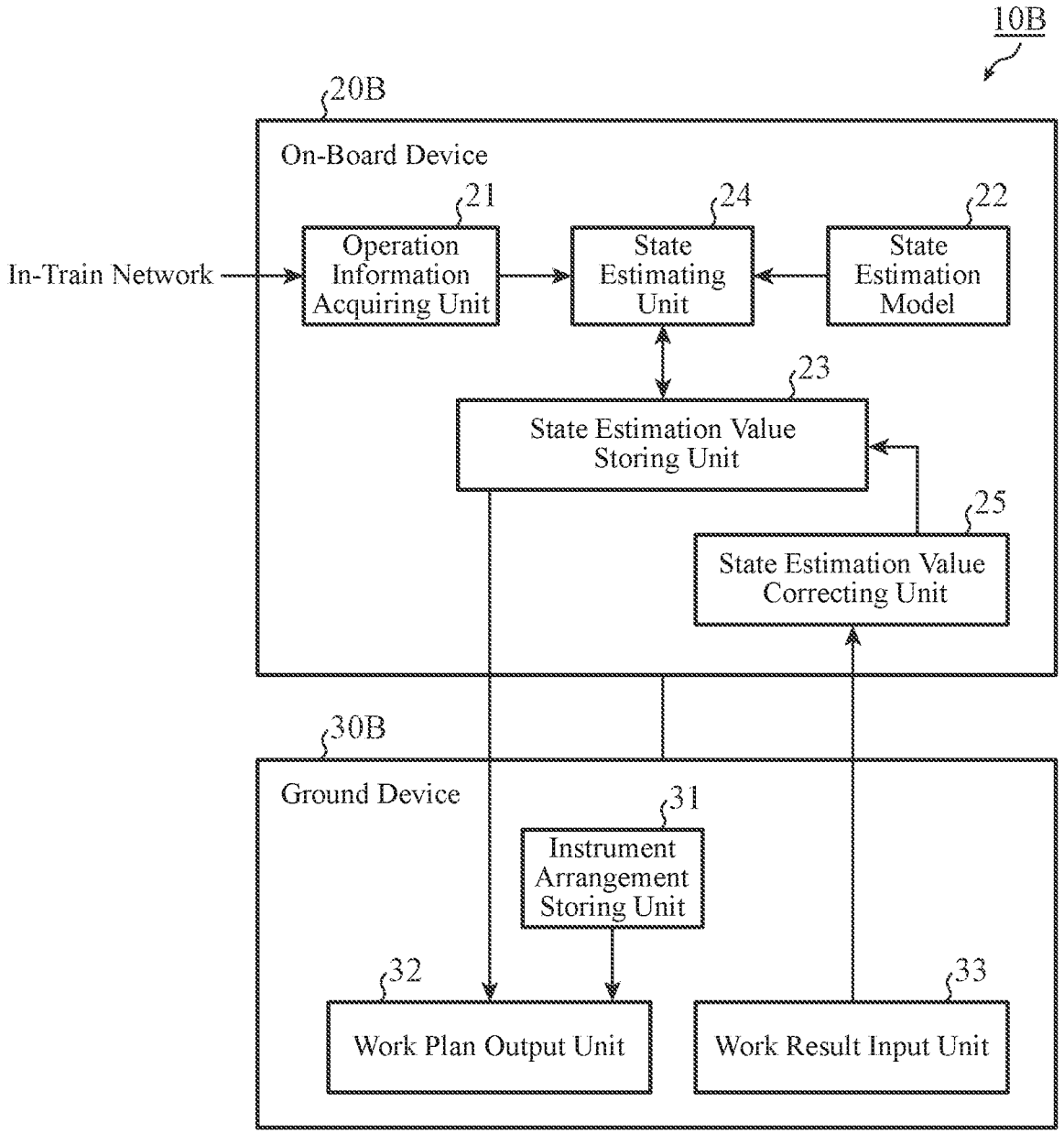
FIG. 13 is a block diagram illustrating a configuration example of a state-monitoring device according to a second embodiment.

FIG. 13 is a block diagram illustrating a configuration example of a state-monitoring device 10B according to the second embodiment. The state-monitoring device 10B reduces an error of the state estimation value by reflecting, in the state estimation value of the instrument, the work result information obtained by performing the maintenance work on the instrument to be maintained. As illustrated in FIG. 13, the state-monitoring device 10B includes an on-board device 20B and a ground device 30B. Note that although FIG. 13 illustrates the state-monitoring device 10B in which the on-board device 20B and the ground device 30B are connected on a one-to-one basis, the ground device 30B may be connected to a plurality of on-board devices 20B mounted on each of a plurality of cars via a network. Further, in consideration that a plurality of maintenance workers use the state-monitoring device 10B, the state-monitoring device 10B may have a configuration in which a plurality of on-board devices 20B and a plurality of ground devices 30B are connected.

The on-board device 20B includes an operation information acquiring unit 21, a state estimation model 22, a state estimation value storing unit 23, a state estimating unit 24, and a state estimation value correcting unit 25. The operation information acquiring unit 21, the state estimation model 22, the state estimation value storing unit 23, and the state estimating unit 24 function similarly to those of the state-monitoring device 10 or 10A according to the first embodiment.

The state estimation value correcting unit 25 corrects the state estimation value stored in the state estimation value storing unit 23 on the basis of the work result information whose input has been received by a work result input unit 33. The state estimating unit 24 estimates the state of the instrument on the basis of the operation information acquired by the operation information acquiring unit 21 and the past state estimation value of the instrument stored in the state estimation value storing unit 23 and corrected by the state estimation value correcting unit 25 in a procedure similar to that of the first embodiment.

The ground device 30B includes an instrument arrangement storing unit 31, a work plan output unit 32, and a work result input unit 33. The instrument arrangement storing unit 31 and the work plan output unit 32 function similarly to those of the state-monitoring device 10 or 10A according to the first embodiment. The work result input unit 33 receives input of work result information indicating a maintenance work result for the instrument to be maintained.

After completion of the work, the maintenance worker inputs the work result using an input device such as a keyboard or a mouse, or inputs the work result at the work site using a touch panel included in the tablet computer. The input of the work result information input by the input device is received by the work result input unit 33. The work result information received by the work result input unit 33 is output to the state estimation value correcting unit 25.

Figures 14, 15:
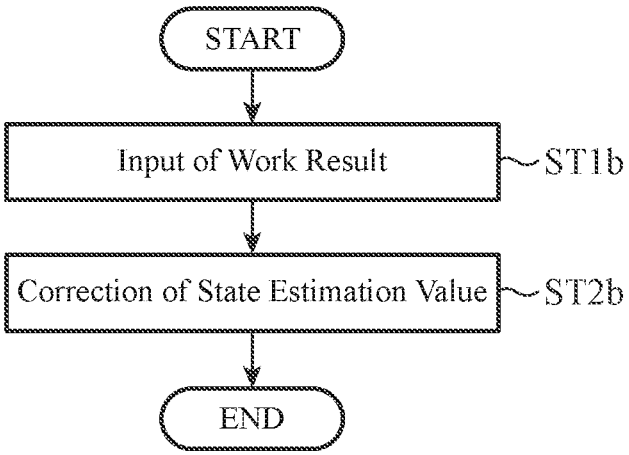
FIG. 14 is a flowchart illustrating input processing of a maintenance work result.
FIG. 15 is a diagram illustrating a display example 1 of a maintenance work result.

FIG. 14 is a flowchart illustrating input processing of a maintenance work result, and illustrates a series of processing that is started by the maintenance worker after work or during work.

The work result input unit 33 receives an input of work result information from the maintenance worker (step ST1*b*). The work result information is information indicating whether or not the maintenance work of the instrument has been performed in accordance with the work plan. FIG. 15 is a diagram illustrating a display example 1 of the maintenance work result, which is displayed on the display device as an input screen of the maintenance work result by the work result input unit 33, for example. In the display example 1 of the maintenance work result, an input field named "Inspection and Replacement result" is added to the information in a table form illustrated in FIG. 12.

The maintenance worker refers to the setting entry named "Necessity of Inspection and Replacement" in the information in a table form illustrated in FIG. 15, and sequentially inspects the instrument for which the circle symbol is set and the instrument for which the double circle symbol is set. In the maintenance work, the maintenance worker performs the component replacement for the instrument that has been estimated not to require component replacement but is actually determined to be in a state requiring the component replacement. On the contrary, the component replacement is not performed for an instrument that has been estimated to require component replacement, but is actually determined to be in a state not requiring the component replacement.

In a case where the maintenance work is performed in accordance with the work plan, for example, in FIG. 15, in a case where it is not necessary to perform component replacement also in the work result for the instrument for which the circle symbol is set in the setting entry of the "Necessity of Inspection and Replacement", the maintenance worker sets an arrow symbol in the input field of the "Inspection and Replacement result". Similarly, in a case where the component replacement is performed for an instrument for which a double circle symbol is set in the setting entry of "Necessity of Inspection and Replacement", the maintenance worker sets an arrow symbol in the input field of "Inspection and Replacement result".

In addition, when the maintenance work is not in the work plan, for example, in FIG. 15, in a case where it has been necessary to perform component replacement in the work result for the instrument for which a circle symbol has been set in the setting entry of "Necessity of Inspection and Replacement", the maintenance worker sets a double circle symbol indicating that the component has been replaced in the input field of "Inspection and Replacement result". When the component replacement has not been performed on the instrument for which a double circle symbol has been set in the setting entry of "Necessity of Inspection and Replacement", the maintenance worker sets a circle symbol indicating that only an inspection has been performed in the input field of "Inspection and Replacement result". In FIG. 15, the instrument C has been planned to perform component replacement, but the component replacement is not actually performed, and the instrument D has been planned not to perform component replacement, but the component replacement is actually performed. Maintenance work is performed on each of the instrument B, the instrument F, the instrument G, the instrument H, the instrument I, and the instrument L as planned.

Next, the state estimation value correcting unit 25 corrects the state estimation value stored in the state estimation value storing unit 23 on the basis of the work result information received by the work result input unit 33 (step ST2*b*). For example, the state estimation value correcting unit 25 refers to the work result information illustrated in FIG. 15 to specify the instrument D, the instrument H, the instrument J, and the instrument L in which the component replacement is actually performed, and resets the state estimation value of the specified instrument to zero among the state estimation values stored in the state estimation value storing unit 23. In addition, the state estimation value correcting unit 25 refers to the work result information illustrated in FIG. 15 to specify the instrument C for which it has been estimated that it has been necessary to perform component replacement in the work plan, but the component replacement is not actually performed, and returns the state estimation value x of the instrument C to the replacement reference value $x_e$.

By the work result input unit 33 receiving the input of the work result from the maintenance worker, the state estimation value correcting unit 25 can reset only the state estimation value of the instrument in which the component replacement is actually performed among the state estimation values stored in the state estimation value storing unit 23. As a result, the actual work result can be reflected in the state estimation value of the instrument.

In a case where the state of the instrument can be measured in the maintenance work, the maintenance worker inputs the measurement result to the ground device 30B. The measurement result is received by the work result input unit 33. The state estimation value correcting unit 25 corrects the state estimation value stored in the state estimation value storing unit 23 depending on the measurement result received by the work result input unit 33. For example, the wear amount of the brake controlling shoe can be measured at the time of inspection of the brake device. The result of actually measuring the state of the instrument is a "state measurement value".

FIG. 16 is a diagram illustrating a display example 2 of the maintenance work result, which is displayed on the display device as an input screen of the maintenance work result by the work result input unit 33, for example. The display example 2 of the maintenance work result is obtained by adding an input field named "Inspection and Replacement result", a display field named "state estimation value", and an input field named "state measurement value" to the information in the table form illustrated in FIG. 12.

The maintenance worker refers to the setting entry named "Necessity of Inspection and Replacement" in the information in a table form illustrated in FIG. 16, and sequentially inspects the instruments for which the circle symbol is set and the instrument for which the double circle symbol is set. In the maintenance work, the maintenance worker obtains the state measurement value of the instrument by measuring the state of the instrument to be maintained using the measuring device. The maintenance worker compares the state measurement value with the replacement reference value to determine whether or not it is necessary to perform component replacement. When the state measurement value of the instrument is equal to or more than the replacement reference value, the maintenance worker performs component replacement of the instrument. The state measurement value is set in an input field of "state measurement value" in the information in a table form illustrated in FIG. 16. When the state measurement value set in the input field is received by the work result input unit 33, the state measurement value is output to the state estimation value correcting unit 25.

The state estimation value correcting unit 25 corrects the state estimation value of each instrument stored in the state estimation value storing unit 23 on the basis of, for example, the maintenance work result information illustrated in FIG. 16. For example, the state estimation value correcting unit 25 replaces the state estimation value of the instrument stored in the state estimation value storing unit 23 with the state measurement value for the instrument to which the state measurement value is input. Note that, since the component replacement is actually performed for the instrument D, the instrument H, the instrument J, and the instrument L, the state estimation value is reset to zero.

When the state of the instrument is actually measured in the maintenance work, the error of the state estimation value of the instrument is reduced by reflecting the measurement result in the state estimation value. The inspection reference value can be brought close to the replacement reference value. When the inspection reference value becomes a value close to the replacement reference value, it is suppressed that an instrument that should be determined not to require inspection in consideration of the life of the instrument is estimated to require inspection, and thus the number of instruments that require inspection can be reduced. As a result, it is possible to reduce labor required for maintenance work of the instruments mounted on the train.

Note that the maintenance work result information illustrated in FIG. 16 illustrates a case where the state estimation values of all the instruments to be maintained are replaced with the state measurement values. However, the state estimation value correcting unit 25 does not necessarily need to correct the state estimation values of all the instruments. For example, it is conceivable that a difference between the state estimation value and the state measurement value is large in the instrument on which unplanned maintenance work is performed. Therefore, the state estimation value correcting unit 25 may replace the state estimation value of only the instrument on which unplanned maintenance work has been performed with the state measurement value.

As described above, the state-monitoring device 10B according to the second embodiment further includes the work result input unit 33 and the state estimation value correcting unit 25. The state estimation value correcting unit 25 corrects the state estimation value stored in the state estimation value storing unit 23 on the basis of the work result information received by the work result input unit 33. The state estimating unit 24 estimates the state of the instrument on the basis of the operation information acquired by the operation information acquiring unit 21 and the state estimation value stored in the state estimation value storing unit 23 and corrected by the state estimation value correcting unit 25. As a result, the actual work result can be reflected in the state estimation value of the instrument.

In the state-monitoring device 10B according to the second embodiment, the work result input unit 33 outputs information indicating whether or not component replacement is required in the instrument to be maintained, and receives input of work result information indicating the instrument for which component replacement has been required but is not required in the maintenance work or the instrument for which component replacement has not been required but is required in the maintenance work. As a result, the actual work result can be reflected in the state estimation value of the instrument.

In the state-monitoring device 10B according to the second embodiment, the work result input unit 33 receives an input of a measurement result of the state of the instrument measured in the maintenance work. The state estimation value correcting unit 25 corrects the state estimation value stored in the state estimation value storing unit 23 depending on the measurement result received by the work result input unit 33. As a result, an error between the state estimation value and the state measurement value of the instrument is reduced.

Third Embodiment

Figure 17:
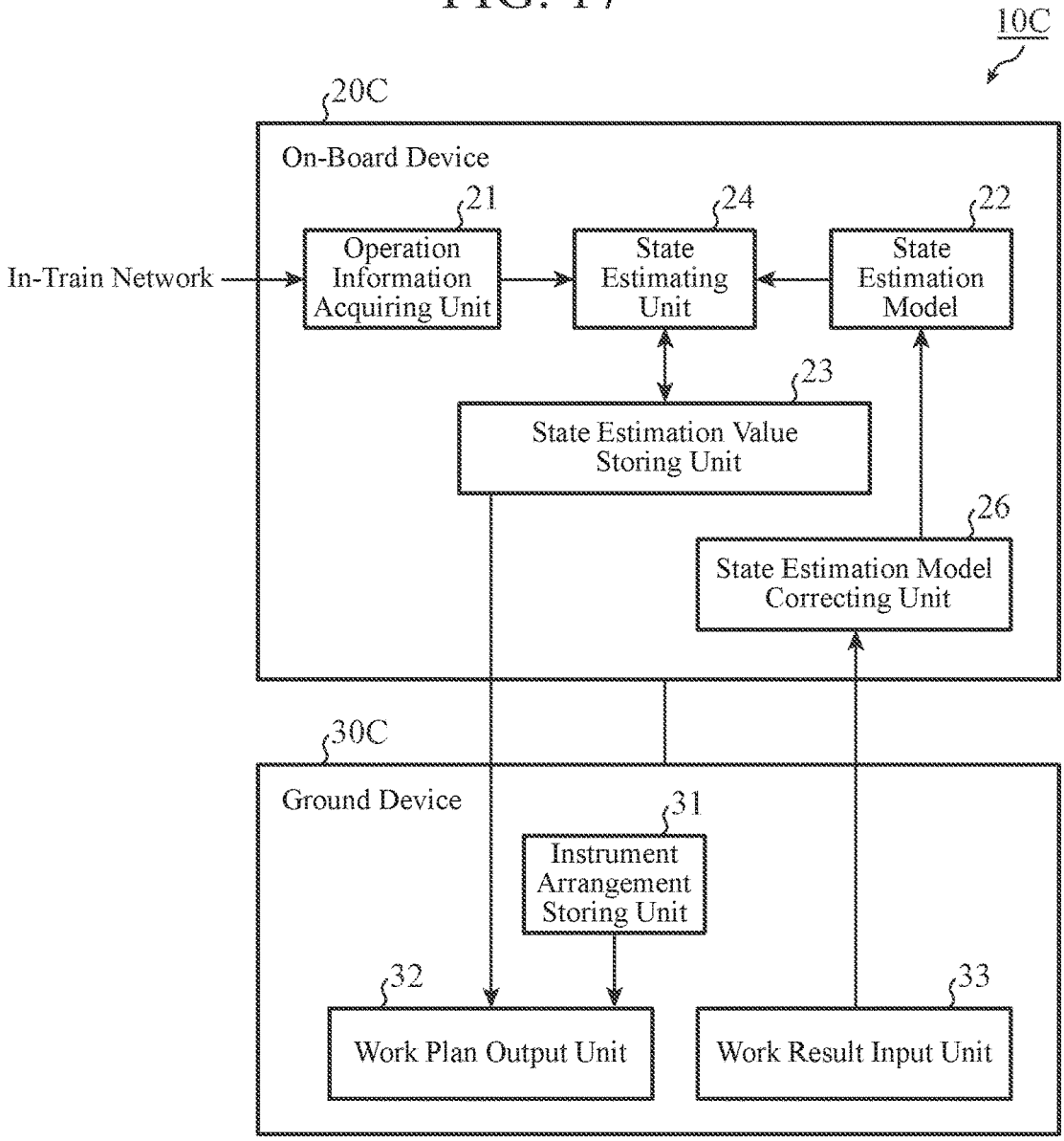
FIG. 17 is a block diagram illustrating a configuration example of a state-monitoring device according to a third embodiment.

FIG. 17 is a block diagram illustrating a configuration example of a state-monitoring device 10C according to the third embodiment. The state-monitoring device 10C corrects the state estimation model 22 using the work result information of the maintenance work performed on the instrument, thereby reducing the error of the state estimation value. As illustrated in FIG. 17, the state-monitoring device 10C includes an on-board device 20C and a ground device 30C. Note that although FIG. 17 illustrates the state-monitoring device 10C in which the on-board device 20C and the ground device 30C are connected on a one-to-one basis, the ground device 30C may be connected to a plurality of on-board devices 20C mounted on each of a plurality of cars via a network. Further, in consideration that a plurality of maintenance workers use the state-monitoring device 10C, the state-monitoring device 10C may have a configuration in which a plurality of on-board devices 20C and a plurality of ground devices 30C are connected.

The on-board device 20C includes an operation information acquiring unit 21, a state estimation model 22, a state estimation value storing unit 23, a state estimating unit 24, and a state estimation model correcting unit 26. The operation information acquiring unit 21, the state estimation model 22, the state estimation value storing unit 23, and the state estimating unit 24 function similarly to those of the state-monitoring device 10 or 10A according to the first embodiment.

The state estimation model correcting unit 26 corrects the state estimation model 22 on the basis of the work result information whose input has been received by the work result input unit 33. The state estimating unit 24 estimates the state of the instrument using the operation information acquired by the operation information acquiring unit 21, the past state estimation value of the instrument stored in the state estimation value storing unit 23, and the state estimation model 22 corrected by the state estimation model correcting unit 26 in a procedure similar to that of the first embodiment.

The ground device 30C includes an instrument arrangement storing unit 31, a work plan output unit 32, and a work result input unit 33. The instrument arrangement storing unit 31 and the work plan output unit 32 function similarly to those of the state-monitoring device 10 or 10A according to the first embodiment. The work result input unit 33 receives input of work result information indicating a maintenance work result for the instrument to be maintained.

After completion of the work, the maintenance worker inputs the work result using an input device such as a keyboard or a mouse, or inputs the work result at the work site using a touch panel included in the tablet computer. The input of the work result information input by the input device is received by the work result input unit 33. The work result information received by the work result input unit 33 is output to the state estimation model correcting unit 26.

If the error of the state estimation value estimated by the state estimation model 22 is small, the inspection reference value can be set to a value close to the replacement reference value. As a result, it is possible to reliably extract an instrument that requires component replacement. However, the change tendency of the state of the instrument gradually changes corresponding to the change in the environment in which the instrument is placed. Therefore, in order to maintain the accuracy of the state estimation model 22, it is necessary to correct the state estimation model 22 during the operation of the state-monitoring device 10C.

In the creation stage of the work plan information before the maintenance work is performed, the state estimating unit 24 estimates the state estimation value x of the instrument by using the operation information T and the state estimation model 22 after the last component replacement in a procedure similar to that in the first embodiment. When the state estimation value x reaches the replacement reference value, it is estimated that the instrument requires component replacement. If the state measurement value x' of the instrument measured during the maintenance work does not reach the replacement reference value, the component replacement of the instrument is not performed. In this case, since the state estimation model 22 is considered to excessively estimate the state estimation value x, the state estimation model correcting unit 26 corrects the state estimation model 22 so that the error x-x' of the state estimation value becomes small.

Generally, there is a variation in the error of the state estimation. Therefore, if the state estimation model 22 is corrected using only the result of the state estimation performed once, the accuracy of the state estimation model 22 may decrease. Therefore, the state estimation model correcting unit 26 corrects the state estimation model 22 so as to output an intermediate value between the state estimation value x and the state measurement value x' by using the state estimation model 22 after correction and the operation information T used for calculating the state estimation value x by the model before correction.

The function of the state estimation model 22 after the correction is expressed by the following Formula (7). When the instrument to be subjected to the state estimation is a brake device including a brake controlling shoe, the state estimation value x can be expressed by the following Formula (8) using the parameter a.

$$M'(T) = \frac{x + x'}{2} \tag{7}$$

$$x = aT \tag{8}$$

The parameter a' after the state estimation model 22 is corrected can be calculated from the following Formula (10) using the following Formula (9). The state estimation model correcting unit 26 can correct the state estimation model 22 in a direction in which accuracy is improved by determining the value of the parameter a' satisfying the following Formula (10).

$$\frac{x + x'}{2} = a'T \tag{9}$$

$$a' = \frac{x + x'}{2T} \tag{10}$$

Figure 18:
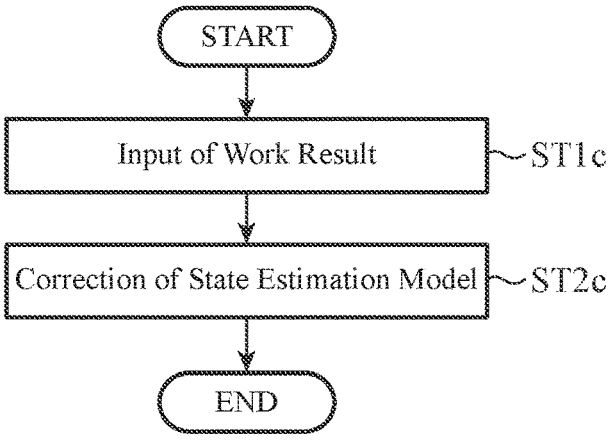
FIG. 18 is a flowchart illustrating correction processing of a state estimation model.

FIG. 18 is a flowchart illustrating correction processing of the state estimation model 22, and is repeatedly executed when the state estimation value is corrected by the work result information received by the work result input unit 33. As a result, it can be expected that the output of the state estimation model 22 gradually approaches the actual state value. The work result input unit 33 receives an input of a work result indicating that the maintenance work of the instrument has been performed on the basis of the state measurement value x' measured during the maintenance work instead of the state estimation value x of the instrument (step ST1*c*).

The state estimation model correcting unit 26 specifies an instrument on which unplanned maintenance work has been performed on the basis of the work result received by the work result input unit 33, and acquires the operation information T when the state estimation value of the instrument has been calculated and the parameter that defines the function of the state estimation model 22 before correction. This parameter is the parameter a in the above Formula (8) when the instrument is the brake device. The state estimation model correcting unit 26 corrects the function of the state estimation model 22 to be M(T)=(x+x')/2 shown in the above Formula (7) in accordance with the above Formula (10) (step ST2*c*). For example, when the instrument is a brake device, the parameter a is replaced with (x+x')/2T in accordance with the above Formula (10).

As described above, the state-monitoring device 10C according to the third embodiment includes the state estimation model correcting unit 26 that corrects the state estimation model 22 on the basis of the work result information whose input has been received by the work result input unit 33. The state estimating unit 24 estimates the state of the instrument using the operation information and the state estimation model 22 corrected by the state estimation model correcting unit 26. As a result, the state-monitoring device 10C can accurately estimate the state of the instrument. That is, since the error of the state estimation value of the instrument is reduced, the inspection reference value can be brought close to the replacement reference value. When the inspection reference value becomes a value close to the replacement reference value, it is suppressed that an instrument that should be determined not to require inspection in consideration of the life of the instrument is estimated to require inspection, and thus the number of instruments that require inspection can be reduced. As a result, it is possible to reduce labor required for maintenance work of the instruments mounted on the train.

Note that combinations of each embodiments, modifications of any components of each of the embodiments, or omissions of any components in each of the embodiments are possible.

INDUSTRIAL APPLICABILITY

The state-monitoring device according to the present disclosure can be used as, for example, an assistance device that assists maintenance work of a plurality of instruments mounted on a train.

REFERENCE SIGNS LIST

1, 2, 3, 4: car, 1A, 1B, 1C, 1D, 2A, 2B, 2C, 2D: instrument, 10, 10A, 10B, 10C: state-monitoring device, 20, 20A, 20B, 20C: on-board device, 21: operation information acquiring unit, 22: state estimation model, 23: state estimation value storing unit, 24: state estimating unit, 25: state estimation value correcting unit, 26: state estimation model correcting unit, 30, 30A, 30B, 30C: ground device, 31: instrument arrangement storing unit, 32: work plan output unit, 33: work result input unit, 100: input interface, 101: output interface, 102: processing circuit, 103: processor, 104: memory

The invention claimed is:

1. A state-monitoring device comprising:

processing circuitry configured to estimate a state of at least one instrument using operation information of a train on which the at least one instrument is mounted;

store instrument arrangement information indicating arrangement of the at least one instrument in the train; and extract the at least one instrument to be maintained that requires inspection or component replacement on a basis of a state estimation value of the at least one instrument, and output information regarding maintenance work in which the at least one instrument to be maintained and the instrument arrangement information are associated with each other, wherein the at least one instrument includes a plurality of instruments, and the processing circuitry is configured to predict the number of instruments that require component replacement for each of areas in which the instruments are arranged, and generate and output work plan information for display in graphic or table form including numerical indications of how many instruments are predicted for each of the areas and a representation of the instruments to be maintained arranged in order along an inspection route on a basis of the instrument arrangement information.

2. The state-monitoring device according to claim 1, wherein the processing circuitry is configured to store a state estimation value representing a state of the at least one instrument at a numerical value;

receive an input of work result information indicating a maintenance work result of the at least one instrument;

correct the stored state estimation value on a basis of the work result information whose input has been received; and estimate the state of the at least one instrument on a basis of the operation information and the stored state estimation value.

3. The state-monitoring device according to claim 2, wherein the processing circuitry is configured to output information indicating whether or not component replacement is required in the at least one instrument to be maintained, and receives input of work result information indicating a first instrument for which component replacement has been required but is not required in maintenance work or a second instrument for which component replacement has not been required but is required in maintenance work.

4. The state-monitoring device according to claim 2, wherein the processing circuitry is configured to receive an input of a measurement result of the state of the at least one instrument measured in the maintenance work, and correct the stored state estimation value depending on the measurement result whose input has been received.

5. The state-monitoring device according to claim 1, wherein the processing circuitry is configured to determine a function for estimating a state of the at least one instrument on a basis of the operation information;

receive an input of work result information indicating a maintenance work result of the at least one instrument;

correct the state estimation model on a basis of the work result information whose input has been received; and estimate the state of the instrument using the operation information and the corrected state estimation model.

6. The state-monitoring device according to claim 1, wherein the processing circuitry is configured to store a state estimation value representing a state of the at least one instrument at a numerical value;

store a corrected state estimation value of the at least one instrument on a basis of work result information indicating a maintenance work result of the at least one instrument, and estimate the state of the at least one instrument on a basis of the operation information and the corrected state estimation value having been stored.

7. The state-monitoring device according to claim 1, wherein the processing circuitry is configured to determine a function for estimating a state of the at least one instrument using the operation information and a past state of the at least one instrument;

correct the state estimation model on a basis of work result information indicating a maintenance work result of the at least one instrument;

store a state estimation value representing the state of the instrument at a numerical value; and estimate the state of the at least one instrument using the operation information, a past state estimation value of the at least one instrument, and the corrected state estimation model.

8. A maintenance work assistance method comprising:

estimating a state of at least one instrument using operation information of a train on which the at least one instrument is mounted;

extracting the at least one instrument to be maintained that requires inspection or component replacement on a basis of a state estimation value of the at least one instrument; and outputting information regarding maintenance work in which the at least one instrument to be maintained and instrument arrangement information indicating arrangement of the instrument stored are associated with each other, wherein the at least one instrument includes a plurality of instruments, and the method further comprises predicting the number of instruments that require component replacement for each of areas in which the instruments are arranged, and generating and outputting work plan information for display in graphic or table form including numerical indications of how many instruments are predicted for each of the areas and a representation of the instruments to be maintained arranged in order along an inspection route on a basis of the instrument arrangement information.

* * * * *